US010669784B2

(12) United States Patent
Vu

(10) Patent No.: US 10,669,784 B2
(45) Date of Patent: Jun. 2, 2020

(54) REMOVABLE DRILL FLOOR

(71) Applicant: Ensco International Incorporated, Wilmington, DE (US)

(72) Inventor: Van Van Vu, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/644,085

(22) Filed: Jul. 7, 2017

(65) Prior Publication Data

US 2018/0010399 A1 Jan. 11, 2018

Related U.S. Application Data

(60) Provisional application No. 62/359,573, filed on Jul. 7, 2016.

(51) Int. Cl.

| | |
|---|---|
| ***B63B 5/00*** | (2006.01) |
| ***E21B 15/02*** | (2006.01) |
| ***E21B 15/00*** | (2006.01) |
| ***B63B 3/48*** | (2006.01) |
| ***B63B 35/44*** | (2006.01) |
| *B65D 88/78* | (2006.01) |

(52) U.S. Cl.

CPC ..... *E21B 15/02* (2013.01); *B63B 3/48* (2013.01); *B63B 35/4413* (2013.01); *E21B 15/00* (2013.01)

(58) Field of Classification Search

CPC ..... B63B 3/48; B63B 3/54; B63B 2003/48; B63B 2003/485; B63B 35/44; B63B 35/4413; B63B 2035/44

USPC ..... 114/76, 85, 256, 258, 259, 264–267, 114/201 R, 202, 232, 233, 364

See application file for complete search history.

(56) References Cited

U.S. PATENT DOCUMENTS

| | | | | |
|---|---|---|---|---|
| 7,628,225 | B2 * | 12/2009 | Petersson | E21B 15/02 166/341 |
| 2002/0166698 | A1 * | 11/2002 | Beato | B63B 21/50 175/7 |
| 2014/0102803 | A1 * | 4/2014 | Storhaug | E21B 7/023 175/162 |
| 2014/0137784 | A1 * | 5/2014 | Ingebretsen | B63B 35/4413 114/264 |
| 2015/0266544 | A1 | 9/2015 | Roper et al. | |

FOREIGN PATENT DOCUMENTS

| | | |
|---|---|---|
| KR | 20130034140 | 4/2013 |
| KR | 20140144513 | 12/2014 |
| KR | 20160046475 | 4/2016 |
| WO | 2015173634 | 11/2015 |

OTHER PUBLICATIONS

PCT Application No. PCT/US2017/041212 International Search Report and Written Opinion dated Oct. 17, 2017, 14 pgs.

* cited by examiner

*Primary Examiner* — Daniel V Venne
(74) *Attorney, Agent, or Firm* — Fletcher Yoder, P.C.

(57) ABSTRACT

Techniques and systems to remove a portion of a drill floor from an offshore vessel. The drill floor may include an immovable section comprising a first portion of a surface area of the drill floor. The drill floor may also include a moveable section comprising a second portion of the surface area of the drill floor. Additionally, the drill floor may include an actuator configured to retract the moveable section from a first position to a second position to remove the second portion of the surface area of the drill floor.

17 Claims, 5 Drawing Sheets

REMOVABLE DRILL FLOOR

CROSS REFERENCE TO RELATED APPLICATIONS

This application is a Non-Provisional application of U.S. Provisional Patent Application No. 62/359,573, entitled "Removable Drill Floor", filed Jul. 7, 2016, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, as wells are drilled at increasing depths, additional components may be utilized to, for example, control and or maintain pressure at the wellbore (e.g., the hole that forms the well) and/or to prevent or direct the flow of fluids into and out of the wellbore. One component that may be utilized to accomplish this control and/or direction of fluids into and out of the wellbore is a blowout preventer (BOP).

BOPs tend to be large structures that consume a substantial amount of space. To deploy and retrieve the BOPs, typically there must be sufficient space between a moon pool and a drill floor of an offshore vessel to position the BOP for deployment and/or to retrieve the BOP for storage or maintenance. Moreover, as large offshore equipment (e.g., BOPs) increase in size, there may be an inadequate amount of distance between the moon pool and the drill floor of an offshore vessel to deploy and retrieve the equipment. One solution may be to raise the drill floor of the offshore vessel. However, this solution may negatively affect the center of gravity of the offshore vessel.

DETAILED DESCRIPTION

Figure 1:
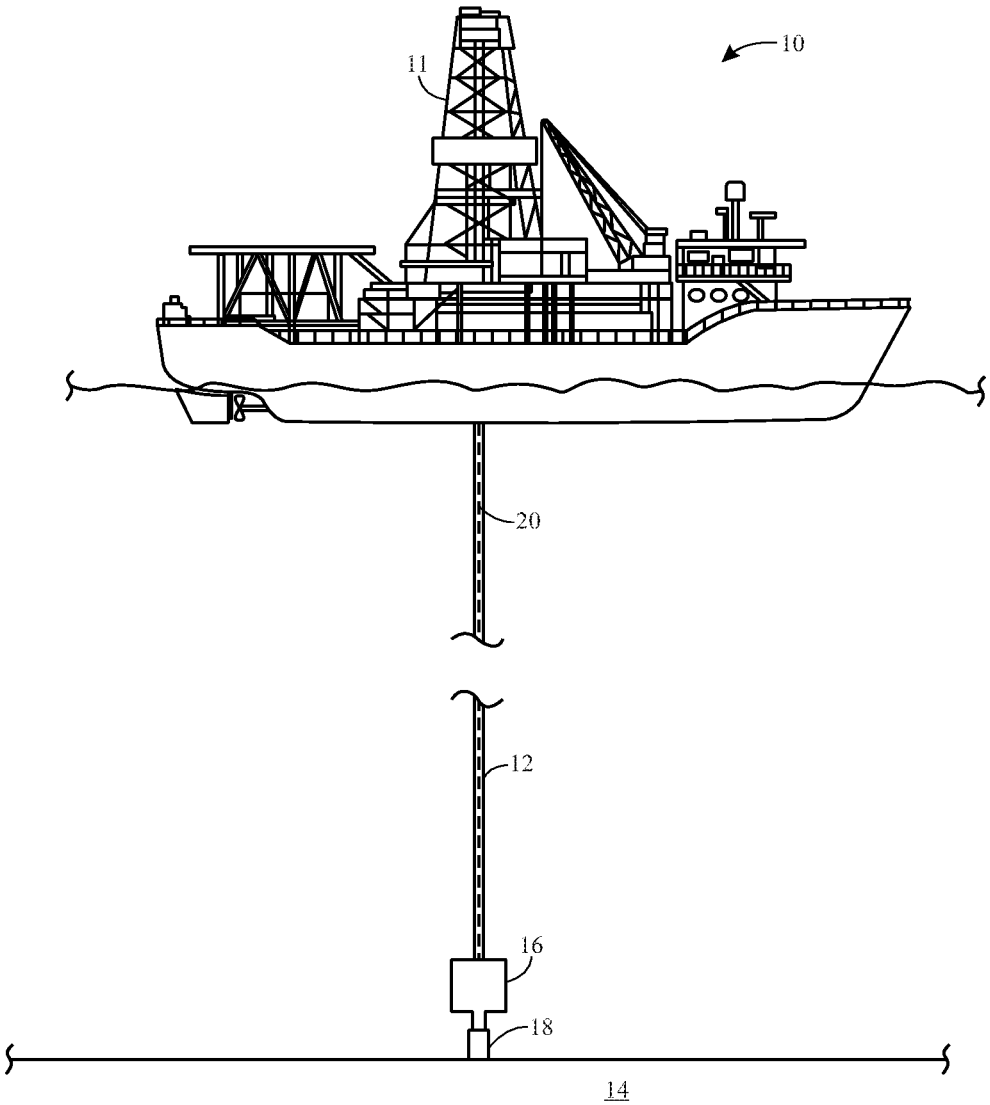
FIG. 1 illustrates an example of an offshore platform having a riser coupled to a wellhead.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for removal of a section of a drill floor of an offshore vessel are set forth below. Subsea equipment has grown in size. Accordingly, the limited space between the top of a drill floor and a V-door of the derrick provides a height restriction that does not allow for launching subsea equipment from above drill floor. Additionally, the distance between a moon pool below the drill floor and the bottom of the drill floor can operate as a restriction to the size of equipment that may be disposed or retrieved from a vertical position over the wellhead of a wellbore. Accordingly, through removal of a section of the drill floor, additional space between the moon pool and the V-door may be achieved to allow for large equipment to be disposed or retrieved from a vertical position over the wellhead of a wellbore. Additionally, removal of a section of the drill floor allows for placement of the larger equipment in a desired position without an associated increase in the height of the drill floor, for example, from the deck of the offshore vessel.

The section of removable drill floor may include one or more portions that may be moved from a closed position (in which the drill floor is enclosed) into an open position (in which the drill floor provides an opening in the enclosure of the drill floor). This may be accomplished, for example, through sliding of one or more portions of the drill floor from the closed position to the open position. Thus, the drill floor may include an immovable section having a first portion of a surface area of the drill floor and at least one moveable section comprising a second portion of the surface area of the drill floor, such that when in the closed position, a full surface area of the drill floor is provided and when in the open position, a portion of the surface area of the drill floor equal to the surface area of the moveable section is removed from the total area of the drill floor. Control of the operation of the drill floor (e.g., the removal and replacement of a section of the drill floor) may be accomplished through the use of a computing system.

With the foregoing in mind, FIG. 1 illustrates an offshore platform comprising a drillship 10. Although the presently illustrated embodiment of an offshore platform is a drillship 10 (e.g., a ship equipped with a drill rig and engaged in offshore oil and gas exploration and/or well maintenance or completion work including, but not limited to, casing and tubing installation, subsea tree installations, and well capping), other offshore platforms such as a semi-submersible platform, a spar platform, a floating production system, or the like may be substituted for the drillship 10. Indeed, while the techniques and systems described below are described in conjunction with drillship 10, the techniques and systems are intended to cover at least the additional offshore platforms described above.

As illustrated in FIG. 1, the drillship 10, having a derrick 11 thereon, includes a riser 12 extending therefrom. The riser 12 may include a pipe or a series of pipes that connect the drillship 10 to the seafloor 14 via, for example, blow out preventer (BOP) 16 that is coupled to a wellhead 18 on the seafloor 14. In some embodiments, the riser 12 may transport produced hydrocarbons and/or production materials between the drillship 10 and the wellhead 18, while the BOP 16 may include at least one valve with a sealing element to control wellbore fluid flows. In some embodiments, the riser 12 may pass through an opening (e.g., a moonpool) in the drillship 10 and may be coupled to drilling equipment of the drillship 10. As illustrated in FIG. 1, it may be desirable to have the riser 12 positioned in a vertical orientation between the wellhead 18 and the drillship 10 to allow a drill string made up of drill pipes 20 to pass from the drillship 10 through the BOP 16 and the wellhead 18 and into a wellbore below the wellhead 18.

Figure 2A:
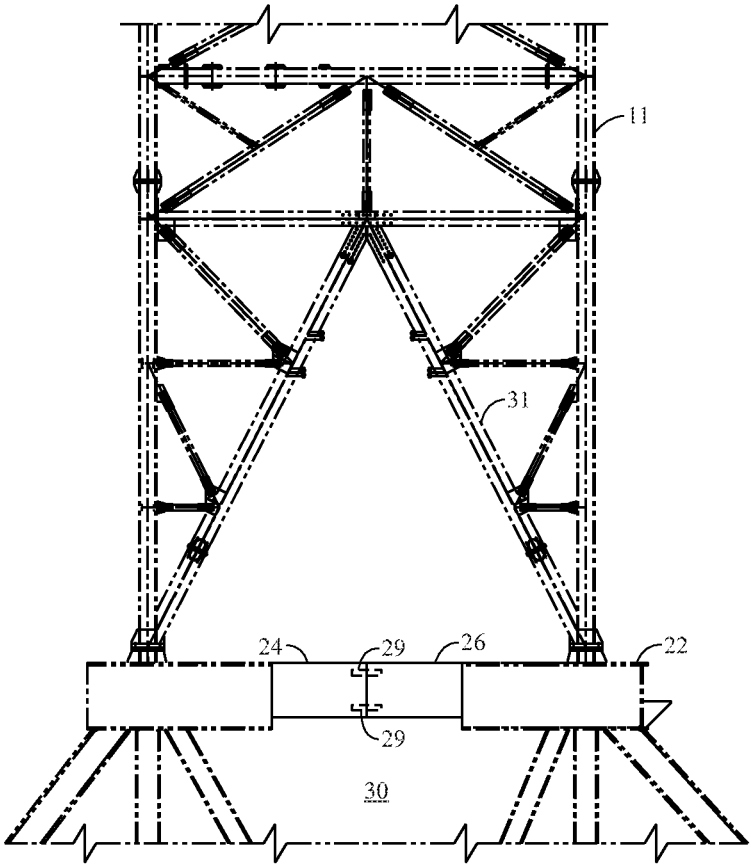
FIG. 2A illustrates a front view of a first position of a drill floor of the offshore platform of FIG. 1.
Figure 2B:
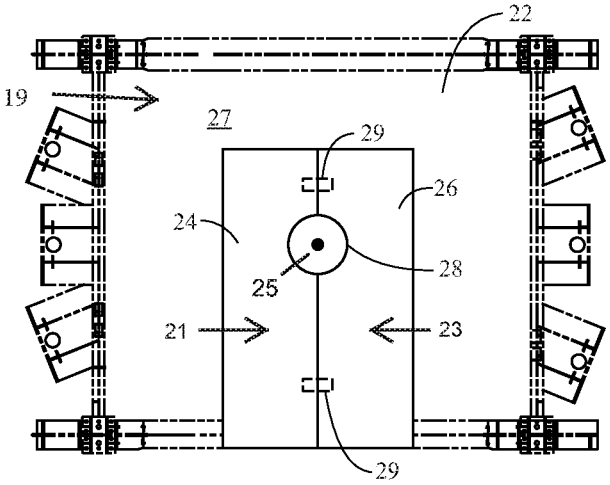
FIG. 2B illustrates a top view of the first position of the drill floor of FIG. 2A.

During operation of the drillship 10, different equipment may be required to be placed in a location, for example, in a position over the wellbore to complete various operational tasks. FIGS. 2A and 2B illustrate a front view and a top view, respectively, of a first position of a drill floor 22 of the offshore platform of FIG. 1. As illustrated, the drill floor 22 may include two sections 24 and 26 that may be movable from the first position illustrated in FIGS. 2A and 2B (e.g., a closed position) into a second position (e.g., an open position) to allow for equipment, such as the BOP 16, a segment of the riser 12, a telescopic joint, a tree, or other offshore equipment to be deployed in an area 28 vertically disposed over the wellhead 18. Additionally, the drill floor 22 may include an immovable portion 27. While two sections 24 and 26 are illustrated, it is envisioned that one, two, three, or more sections may be present in the drill floor 22 and may be movable to open an area in the drill floor 22. Additionally, the sections 24 and 26 may have approximately the same surface area or one section (e.g., section 24) may have a surface area of approximately 1.5 times, 2 times, 2.5 times, 3 times, or another multiple amount of surface area relative to another section (e.g., section 26).

As illustrated in FIG. 2B, the sections 24 and 26 may include an aperture over area 28. This aperture can be sized to fit a rotary table 25 that may be utilized in conjunction with or separate from a top drive (e.g., any known or conventional top drive). In some embodiments, the rotary table 25 may be movable, horseshoe shaped, hinged, or the like to allow for access to area 28 (e.g., to allow equipment to be positioned in area 28 without interference from the rotary table 25. In some embodiments, the rotary table 25 and any associated bushings may be retractable with the sections 24 and 26 such that the rotary table 25 may be removed from area 28 as sections 24 and 26 are moved from a closed position to an open position.

Additionally, the drill floor 22 may include locking features 29 that may be disengaged, in some embodiments, as controlled by a computing system. These locking features 29 may include retractable pins, bolts, or the like that extend from one section (e.g., section 24) into apertures of a second section (e.g., section 26). Regardless of the configuration utilized, the locking features 29 operate to affix the sections 24 and 26 to one another when in the closed position illustrated in FIGS. 2A and 2B and their disengagement allows for lateral (and/or vertical) movements of the sections 24 and 26 for movement of the sections 24 and 26 into an open position.

As previously noted, an area 30 beneath the drill floor 22 and above the moon pool of the offshore vessel 10 may be inadequate to allow for the positioning of the offshore equipment into area 28 (e.g., an upper portion of the equipment to be deployed may be precluded from moving into area 28 via the drill floor 22 when it is in a closed position). Additionally, the distance between the top of a v-door 31 in the structure and the drill floor 22 may also be inadequate to allow for the positioning of the offshore equipment into area 28 when the drill floor 22 is in the closed position. Thus, sections 24 and 26 of the drill floor 22 may be moved from their illustrated closed position into a second (e.g., open position) via retraction mechanisms, which are discussed in greater detail below with respect to FIGS. 3A and 3B.

Figure 3A:
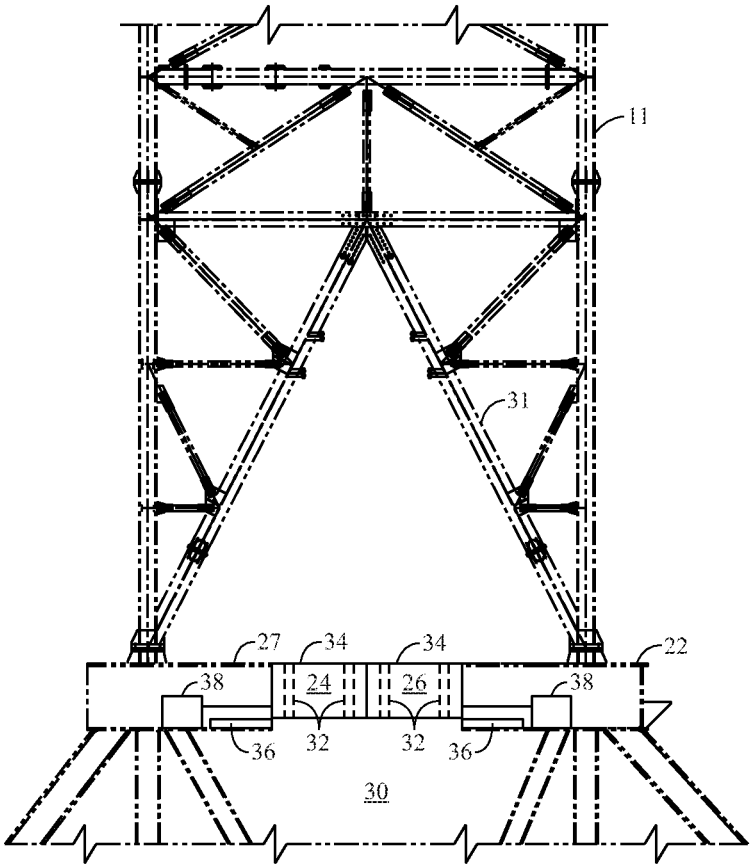
FIG. 3A illustrates a cutaway front view of the first position of the drill floor of the offshore platform of FIG. 1.
Figure 3B:
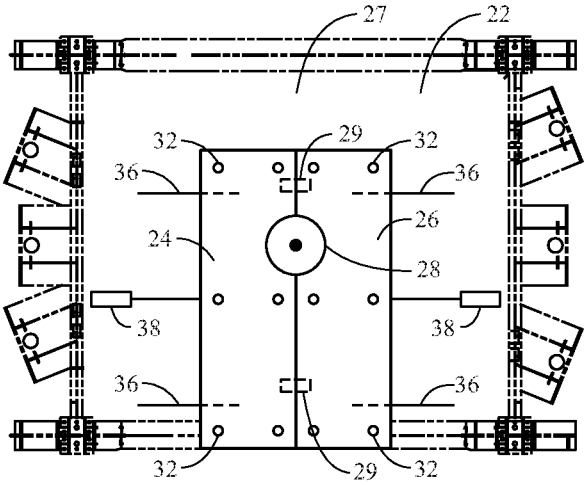
FIG. 3B illustrates a cutaway top view of the first position of the drill floor of FIG. 2A.

FIG. 3A illustrates a cutaway front view of the drill floor 22 in a closed position while FIG. 3B illustrates a cutaway top view the drill floor 22 in a closed position. As illustrated, the sections 24 and 26 may each include mechanical actuators 32 (e.g., hydraulic cylinders, support arms operated by a gear train or motor device, or the like) that may operate to provide support for a top portion 34 of the sections 24 and 26 and may, for example, allow for vertical movement of the top portion 34 of the sections 24 and 26 with respect to the immovable portion 27 of the drill floor 22 (e.g., to allow the top portion 34 of the sections 24 and 26 be dropped below the surface of the immovable portion 27 of the drill floor 22 to allow the sections 24 and 26 to be moved away from the area 28). Additionally, when the sections 24 and 26 are in the closed position, the mechanical actuators 32 may raise the top portion 34 of the sections 24 and 26 to a level even with the immovable portion 27 of the drill floor 22, so as to provide a level surface across the drill floor 22. In other embodiments, the top portion 34 of the sections 24 and 26 may be vertically immovable and disposed at a height of approximately ¼ of an inch, ½ of an inch, ¾ of an inch, or an inch below the surface of the remaining portion of the drill floor 22.

To facilitate lateral movement of the sections 24 and 26 (e.g., to move sections 24 and 26 into an open position that allows for access to area 28 through the drill floor 22), one or more tracks 36 may guide sections 24 and 26 of the drill floor 22. The tracks 36 may be rails or similar guides that may interface, for example, with rollers or the like disposed beneath the sections 24 and 26. Additionally, one or more linear actuators 38 may be present to impart force to cause motion of the sections 24 and 26 along the tracks 36. In one embodiment, each linear actuator 38 may include a hydraulic cylinder or a similar actuator. In some embodiments, the operation of each linear actuator 38, as well as activation of the mechanical actuators 32, may be controlled by a computing system. For example, the sections 24 and 26 may each be moved by respective linear actuators 38 concurrently (as controlled by the computing system), such that movement of each section 24 and 26 is simultaneous (e.g., performed at a common speed). In this manner, the one or more linear actuators 38 may operate to extend and retract the sections 24 and 26 as required to allow for additional clearance of equipment passing through v-door 31.

Figure 4A:
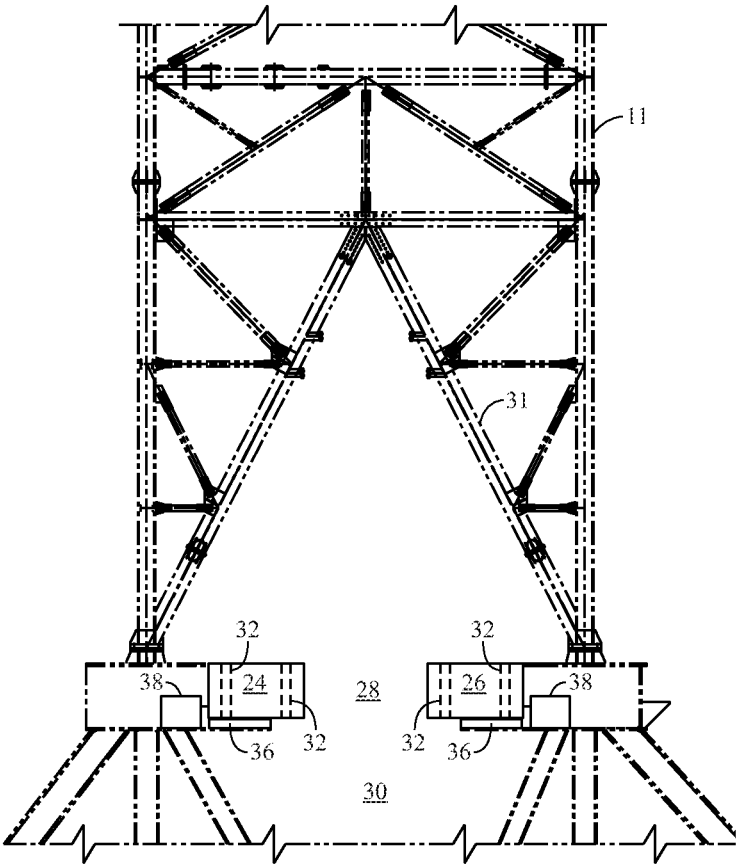
FIG. 4A illustrates a cutaway front view of a second position of the drill floor of the offshore platform of FIG. 1.
Figure 4B:
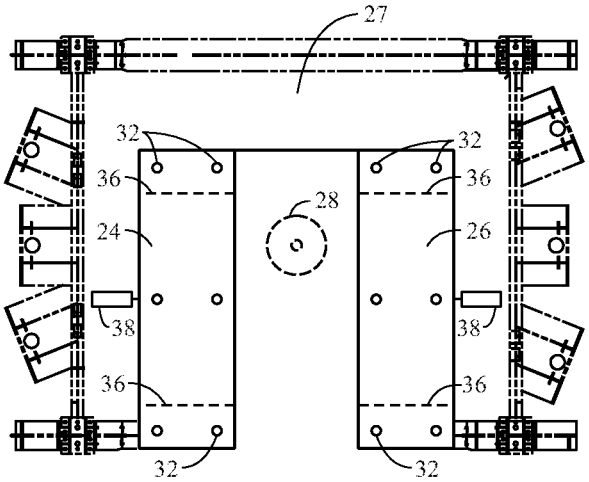
FIG. 4B illustrates a cutaway top view of the second position of the drill floor of FIG. 4A.

FIG. 4A illustrates a cutaway front view of the drill floor 22 in an open position while FIG. 4B illustrates a cutaway top view the drill floor 22 in the open position. As illustrated, the sections 24 and 26 may have moved laterally along the one or more tracks 36 to allow for access to area 28 through the drill floor 22. The linear actuators 38 may be utilized to provide the motion to sections 24 and 26 along the tracks 36 (e.g., to retract the sections 24 and 26 into the immovable portion 27 of the drill floor 22). As previously noted, the operation of each linear actuator 38, as well as activation of the mechanical actuators 32, may be controlled by a computing system. Additionally, once the equipment has been deployed, the computing system may control each linear actuator 38, as well as activation of the mechanical actuators 32, to move the sections 24 and 26 back into the closed position of FIGS. 3A and 3B. This computing system will be described below in greater detail with respect to FIG. 5.

Figure 5:
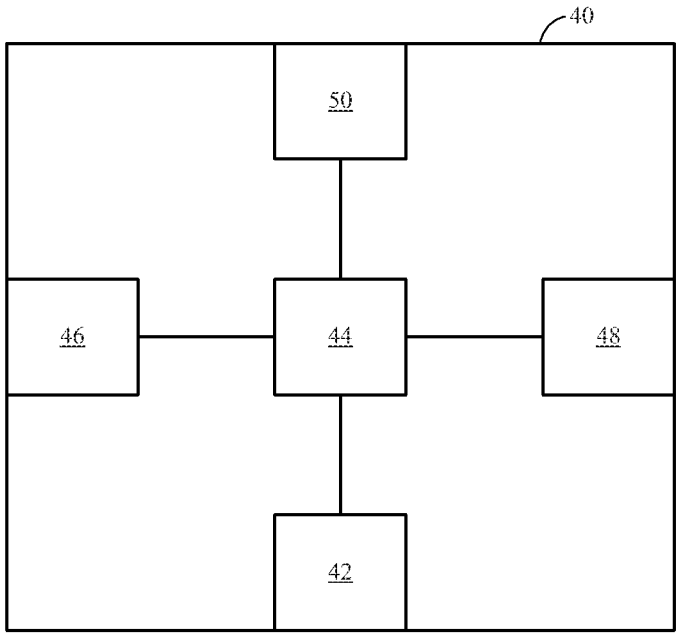
FIG. 5 illustrates a block diagram of a computing system used in conjunction with the drill floor of FIGS. 2A-4B.

FIG. 5 illustrates the computing system 40. It should be noted that the computing system 40 of drillship 10 may operate in conjunction with software systems implemented as computer executable instructions stored in a non-transitory machine readable medium of computing system 40, such as memory 42, a hard disk drive, or other short term and/or long term storage. Particularly, the techniques to control the lateral movement of the sections 24 and 36 of the drill floor 22 between the closed position and the open position, the techniques to control any vertical movement of the top portion 34 of the sections 24 and 26, techniques to control the locking features 29 may be performed using code or instructions stored in a non-transitory machine readable medium of computing system 40 and may be executed, for example, by one or more processors 44 or a controller of computing system 40. Accordingly, computing system 40 may include an application specific integrated circuit (ASIC), one or more processors 44, or another processing device that interacts with one or more tangible, non-transitory, machine-readable media of computing system 40 that collectively stores instructions executable by a processing device of the computing system 40 to generate, for example, control signals to be transmitted to, for example, one or more of the locking mechanisms 29, one or more of the mechanical actuators 32, and/or one or more of the linear actuators 38 to cause the steps and actions described above to be performed. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor 44 or by any general purpose or special purpose computer or other machine with a processor 44.

Thus, the computing system 40 may include a processor 44 that may be operably coupled with the memory 42 to perform various algorithms. Such programs or instructions executed by the processor(s) 44 may be stored in any suitable article of manufacture that includes one or more tangible, computer-readable media at least collectively storing the instructions or routines, such as the memory 42. Additionally, the computing system 42 may optionally include a display 46, which may be a liquid crystal display (LCD) or other type of display, and allows users to view images generated by the computing system 40. The display 46 may include a touch screen, which may allow users to interact with a user interface of the computing system 40.

The computing system 40 may also include one or more input structures 48 (e.g., a keypad, mouse, touchpad, one or more switches, buttons, or the like) to allow a user to interact with the computing system 40, for example, to start, control, or operate a GUI or applications running on the computing system 40 and/or to start, control, or operate the techniques to (laterally) move the sections 24 and 26 between the closed position and the open position, as well as the techniques to control the locking features 29, and techniques to vertically move top portion 34 of the sections 24 and 26. Additionally, the computing system 40 may include network interface 50 to allow the computing system 40 to interface with various other electronic devices. The network interface 50 may include a Bluetooth interface, a local area network (LAN) or wireless local area network (WLAN) interface, an Ethernet connection, or the like. The computer system 40, which may be a stand-alone unit, for example, adjacent to the derrick 11 or may be part of a larger control system of the drillship 10, may be utilized to control the process of removing a portion of the drill floor 22.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. An offshore vessel, comprising:

a drill floor disposed above a moon pool of the offshore vessel; and a derrick disposed on the drill floor, wherein the derrick comprises a V-door in an area above the drill floor, wherein the drill floor comprises:

an immovable portion comprising a first portion of a surface area of the drill floor;

a moveable section comprising a second portion of the surface area of the drill floor; and an actuator configured to retract the moveable section from a first position adjacent to the immovable portion to a second position within the immovable portion and beneath the first portion of the surface area of the drill floor to remove the portion of the surface area of the drill floor to achieve additional space as a continuous opening between the V-door of the derrick and the moon pool of the offshore vessel.

2. The offshore vessel of claim 1, comprising a second movable section comprising a third portion of the surface area of the drill floor.

3. The offshore vessel of claim 2, comprising a second actuator configured to retract the second moveable section from a third position adjacent to the immovable portion to a fourth position within the immovable portion and beneath the first portion of the surface area of the drill floor to remove the third portion of the surface area of the drill floor.

4. The offshore vessel of claim 2, comprising a locking feature configured to couple the moveable section to the second movable section.

5. The offshore vessel of claim 2, comprising an area in the drill floor disposed between the moveable section and the second movable section.

6. The offshore vessel of claim 5, comprising a rotary table disposed in the area.

7. The offshore vessel of claim 6, wherein the rotary table is removable from the area.

8. The offshore vessel of claim 1, comprising a mechanical actuator configured to support the moveable section during movement of the moveable section from a first vertical position level with the immovable portion to a second vertical position below the first vertical position.

9. The offshore vessel of claim 1, comprising a track configured to guide the moveable section when moving from the first position to the second position.

10. A method of moving a removable section of a drill floor of an offshore vessel, comprising:

moving a removable section of the drill floor, disposed above a moon pool of the offshore vessel and below a V-door of a derrick disposed on the drill floor, from a first position adjacent to an immovable portion of the drill floor comprising a first portion of a surface area of the drill floor to a second position within the immovable portion and beneath the first portion of the surface area of the drill floor to remove a second portion of the surface area of the drill floor to achieve additional space as a continuous opening between the V-door of the derrick and the moon pool of the offshore vessel.

11. The method of claim 10, comprising moving the removable section of the drill floor from a first vertical position level with the immovable portion of the drill floor as the first position to a second vertical position below the first vertical position.

12. The method of claim 11 comprising moving the removable section of the drill floor along a track from the second vertical position to the second position.

13. The method of claim 12, comprising moving a second removable section of the drill floor from a third position adjacent to the immovable portion to a fourth position within the immovable portion and beneath the first portion of the surface area of the drill floor to remove a third portion of the surface area of the drill floor.

14. The method of claim 13, comprising moving the second removable section of the drill floor from a third vertical position level with the immovable portion of the drill floor as the third position to a fourth vertical position below the third vertical position.

15. The method of claim 14 comprising moving the second removable section of the drill floor along a second track from the fourth vertical position to the fourth position.

16. The method of claim 12, comprising moving the removable section of the drill floor along the track from the second position to the second vertical position.

17. The method of claim 16, comprising moving the removable section of the drill floor from the second vertical position to the first position.

* * * * *